US008357217B2

(12) United States Patent
Huang et al.

(10) Patent No.: US 8,357,217 B2
(45) Date of Patent: Jan. 22, 2013

(54) METHOD AND APPARATUS FOR MAKING A FIXED ABRASIVE WIRE

(75) Inventors: Hong-Ting Huang, Taipei (TW); Chin-Yu Tso, Taipei (TW); Shang-wanq Yeh, Taoyuan County (TW); Hsiou-Jeng Shy, New Taipei (TW)

(73) Assignees: Chung-Shan Institute of Science and Technology, Taoyuan County (TW); Armaments, Bureau, Ministry of National Defense, Taoyuan County (TW)

( * ) Notice: Subject to any disclaimer, the term of this patent is extended or adjusted under 35 U.S.C. 154(b) by 0 days.

(21) Appl. No.: 13/118,502

(22) Filed: May 30, 2011

(65) Prior Publication Data

US 2012/0304546 A1 Dec. 6, 2012

(51) Int. Cl.

| | |
|---|---|
| ***B24D 3/02*** | (2006.01) |
| ***C09C 1/68*** | (2006.01) |
| ***C09K 3/14*** | (2006.01) |

(52) U.S. Cl. ..... 51/309; 51/307; 205/110

(58) Field of Classification Search ..... None
See application file for complete search history.

(56) References Cited

U.S. PATENT DOCUMENTS

| | | | | |
|---|---|---|---|---|
| 3,105,139 | A * | 9/1963 | Russell | 219/56.22 |
| 3,141,232 | A * | 7/1964 | Russell | 29/613 |
| 3,208,137 | A * | 9/1965 | Knauf, Jr | 228/124.1 |
| 3,860,400 | A * | 1/1975 | Prowse et al. | 51/295 |
| 6,945,242 | B2 * | 9/2005 | Kondo et al. | 125/21 |
| 2008/0261499 | A1 * | 10/2008 | Tani et al. | 451/528 |
| 2010/0006082 | A1 * | 1/2010 | Glinski et al. | 125/16.02 |
| 2010/0218842 | A1 * | 9/2010 | Glinski et al. | 140/92.1 |
| 2011/0039070 | A1 * | 2/2011 | Liebelt et al. | 428/143 |

FOREIGN PATENT DOCUMENTS

| | | | |
|---|---|---|---|
| EP | 1886753 | A1 * | 2/2008 |
| JP | 63022275 | A * | 1/1988 |
| JP | 09001455 | A * | 1/1997 |

* cited by examiner

*Primary Examiner* — Kaj K Olsen
*Assistant Examiner* — Ross J Christie
(74) *Attorney, Agent, or Firm* — Jackson IPG PLLC

(57) ABSTRACT

A method and apparatus for making a fixed abrasive grain wire includes, at first, inserting a wire through a sleeve that includes at least one aperture defined therein. Then, both of the wire and the sleeve are located in electroplating or electro-less plating liquid that includes abrasive grains blended therein. Finally, electroplating or electro-less plating is executed to fix some of the abrasive grains to the wire.

8 Claims, 6 Drawing Sheets

METHOD AND APPARATUS FOR MAKING A FIXED ABRASIVE WIRE

BACKGROUND OF INVENTION

1. Field of Invention

The present invention relates to a fixed abrasive wire and, more particularly, to a method and apparatus for making a fixed abrasive wire.

2. Related Prior Art

The photoelectrical industry has been booming recently. There is a growing need for precious, hard and brittle materials such as silicon wafers, sapphire and agate. Silicon wafers are essential for the development of integrated circuits. The silicon wafers are sliced into dies for integrated circuits. During the slicing of the silicon wafers, there is always loss of materials, and the slicing of the wafers is hence expensive. There is a need for an excellent wafer-slicing process.

A wafer can be sliced with a sawing wire. The sawing wire may be operated in a free abrasive manner or a fixed abrasive manner. In the free abrasive manner, a wire is used with abrasive paste for slicing. The efficiency and precision of the free abrasive operation are low, and the consumption of the abrasive paste pollutes the environment.

In the fixed abrasive manner, abrasive grains are fixed to a wire by adhesive, electroplating or electro-less plating for example. The efficiency and precision of the fixed abrasive operation are high, and there is no waste related to the disposal of any abrasive paste. Therefore, the fixed abrasive operation is popular.

A method for making a fixed abrasive wire by electroplating was devised by Ken-Ichi Ishikawa in 1994. In the method, a tank that contains abrasive grains such as diamond grains is used as a composite electroplating tank. A wall of the tank is made with apertures of a diameter of 10 mm and coated with a Teflon film that is 3 μm thick. The abrasive grains are restrained in the tank by the Teflon film while nickel-based electroplating liquid is allowed to flow through the tank. A wire electrically connected to the cathode of a power supply is buried in the abrasive grains and electroplated in the electroplating liquid so that some of the abrasive grains can be fixed to the wire. However, the area of the contact of the electroplating liquid with the wire is small, and the electroplating takes a long time. Furthermore, it is difficult to control the amount and distribution of the abrasive grains fixed to the wire.

In a typical method for making a fixed abrasive wire by adhesive, abrasive grains are fixed to a wire by adhesive that includes copper, tin or titanium in a high-temperature chamber filled with inert gas or a high-temperature vacuum chamber. The control over the abrasive grains is good. However, the wire and abrasive grains could be damaged in the high-temperature chamber, and mechanical properties of the resultant fixed abrasive wire are jeopardized.

The foregoing methods for making fixed abrasive wires are not without problems. Therefore, the present invention is intended to obviate or at least alleviate the problems encountered in prior art.

SUMMARY OF INVENTION

It is an objective of the present invention to provide a method for making a fixed abrasive wire via electroplating.

To achieve the foregoing objective, the method includes the step of inserting a wire through a sleeve including at least one aperture defined therein, the step of locating the wire and the sleeve in electroplating liquid including abrasive grains blended therein, and the step of executing electroplating to fix some of the abrasive grains to the wire.

The sleeve includes at least one open end in a shape selected from the group consisting of circular, oval, triangular or rectangular. The diameter of the open end of the sleeve is 1 to 20 mm.

The aperture is circular, oval, triangular or rectangular. The diameter of the aperture is 0.05 to 10 mm.

The abrasive grains are made of silicon carbide, baron carbide, tungsten carbide, baron nitride, diamond, aluminum oxide, zirconium oxide or quartz. The diameter of the abrasive grains is 1 to 60 μm.

The sleeve is located in a vertical, horizontal or inclined manner.

It is another objective of the present invention to provide a method for making a fixed abrasive wire via electro-less plating.

To achieve the foregoing objective, the method includes the step of inserting a wire through a sleeve including at least one aperture defined therein, the step of locating the wire and the sleeve in electroplating liquid including abrasive grains blended therein, and the step of executing electro-less plating to fix some of the abrasive grains to the wire.

The sleeve includes at least one open end in a shape selected from the group consisting of circular, oval, triangular or rectangular. The diameter of the open end of the sleeve is 1 to 20 mm.

The aperture is circular, oval, triangular or rectangular. The diameter of the aperture is 0.05 to 10 mm.

The abrasive grains are made of silicon carbide, baron carbide, tungsten carbide, baron nitride, diamond, aluminum oxide, zirconium oxide or quartz. The diameter of the abrasive grains is 1 to 60 μm.

The sleeve is located in a vertical, horizontal or inclined manner.

It is another objective of the present invention to provide an apparatus for making a fixed abrasive wire.

To achieve the foregoing objective, the apparatus includes a tank, reaction liquid filled in the tank, abrasive grains mixed in the reaction liquid, a sleeve including at least one aperture defined therein. The sleeve is submerged in the reaction liquid in the tank. A wire is moved through the sleeve while some of the abrasive grains are fixed to the wire.

The reaction liquid may be electro-less plating liquid.

Alternatively, the reaction liquid may be electroplating liquid. In this case, the apparatus further includes a power supply located outside the tank and at least one anode plate submerged in the reaction liquid filled in the tank and electrically connected to the anode of the power supply.

Other objectives, advantages and features of the present invention will be apparent from the following description referring to the fixed drawings.

BRIEF DESCRIPTION OF DRAWINGS

The present invention will be described via detailed illustration of several embodiments referring to the drawings wherein.

DETAILED DESCRIPTION OF EMBODIMENTS

Figure 1:
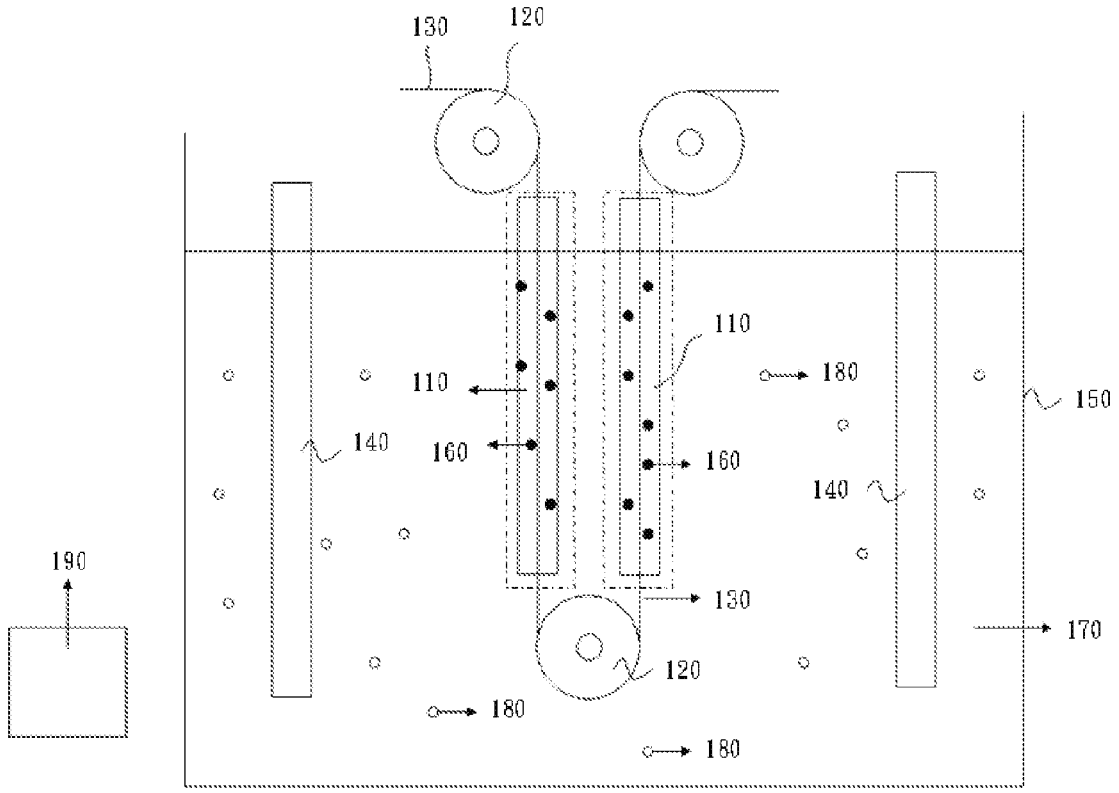
FIG. 1 is a front view of an apparatus for making a fixed abrasive wire according to the first embodiment of the present invention.

Referring to FIG. 1, there is shown an apparatus for making a fixed abrasive wire according to a first embodiment of the present invention. The apparatus includes two sleeves 110, three wheels or pulleys 120 and a tank 150. The tank 150 is filled with reaction liquid 170. Abrasive grains 180 are mixed in the reaction liquid 170.

Figure 2:
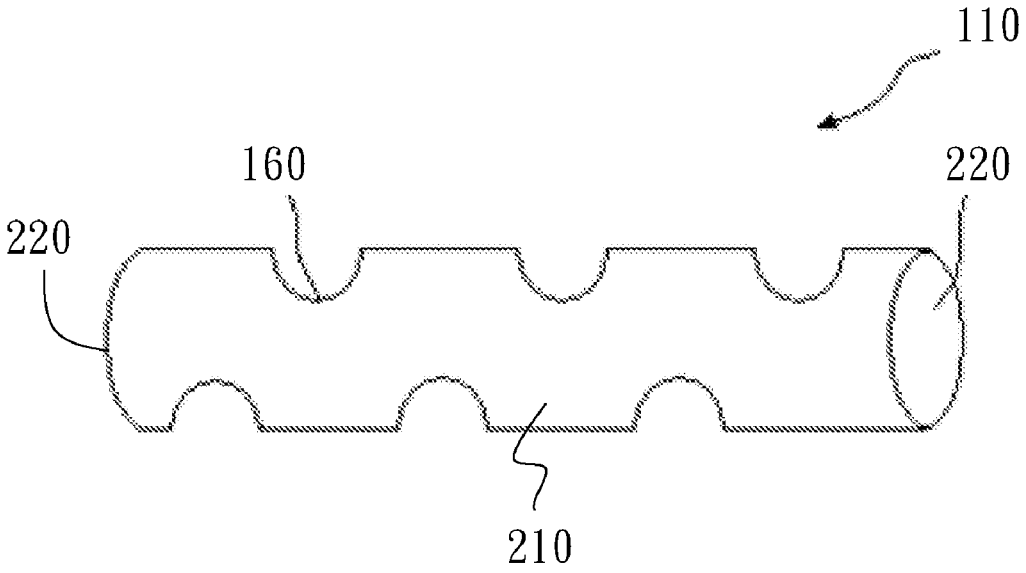
FIG. 2 is perspective view of a sleeve of the apparatus shown in FIG. 1.

Referring to FIG. 2, each of the sleeves 110 includes a tubular wall 210 formed with two open ends 220 and apertures 160 transversely defined in the tubular wall 210. The open ends 220 may be circular, oval, triangular, rectangular or in any other proper shape. The diameter of the open ends 220 is 1 to 20 mm if the open ends 220 are circular. The largest diameter of the open ends 220 is 1 to 20 mm if the open ends 220 are in another shape.

The apertures 160 may be circular, oval, triangular, rectangular or in any other proper shape. The diameter of the apertures 160 is 0.05 to 10 mm if the open ends 220 are circular. The largest diameter of the apertures 160 is 0.05 to 10 mm if the open ends 220 are in another shape. The apertures 160 are distributed regularly or irregularly.

Referring to FIG. 1, the sleeves 110 are submerged in the reaction liquid 170 filled in the tank 150. The sleeves 110 extend vertically in the tank 150 as shown; however, the sleeves 110 can extend horizontally or in an inclined manner in the tank 150.

Two of the wheels 120 (the "upper wheels 120") are located outside the tank 150 while the other wheel 120 (the "lower wheel 120") is located in the tank 150. Each of the sleeves 110 is located between a related one of the upper wheels 120 and the lower wheel 120.

There are two sleeves 110 and three wheels 120 as shown; however, there can be only one sleeve 110 or any other proper number of sleeves 110 and a corresponding number of wheels 120.

The reaction liquid 170 may be electro-less plating liquid or electroplating liquid. The apparatus includes only the sleeves 110, the wheels 120 and the tank 150 if the reaction liquid 170 is electro-less plating liquid.

The apparatus includes at least one anode plate 140 and a power supply 190 in addition to the sleeves 110, the wheels 120 and the tank 150 if the reaction liquid 170 is electroplating liquid. The anode plate 140 is submerged in the reaction liquid 170 filled in the tank 150 and electrically connected to the anode of the power supply 190.

The diameter of the abrasive grains 180 is 1 to 60 μm. The abrasive grains 180 may be made of silicon carbide, baron carbide, tungsten carbide, baron nitride, diamond, aluminum oxide, zirconium oxide or quartz.

Figure 3:
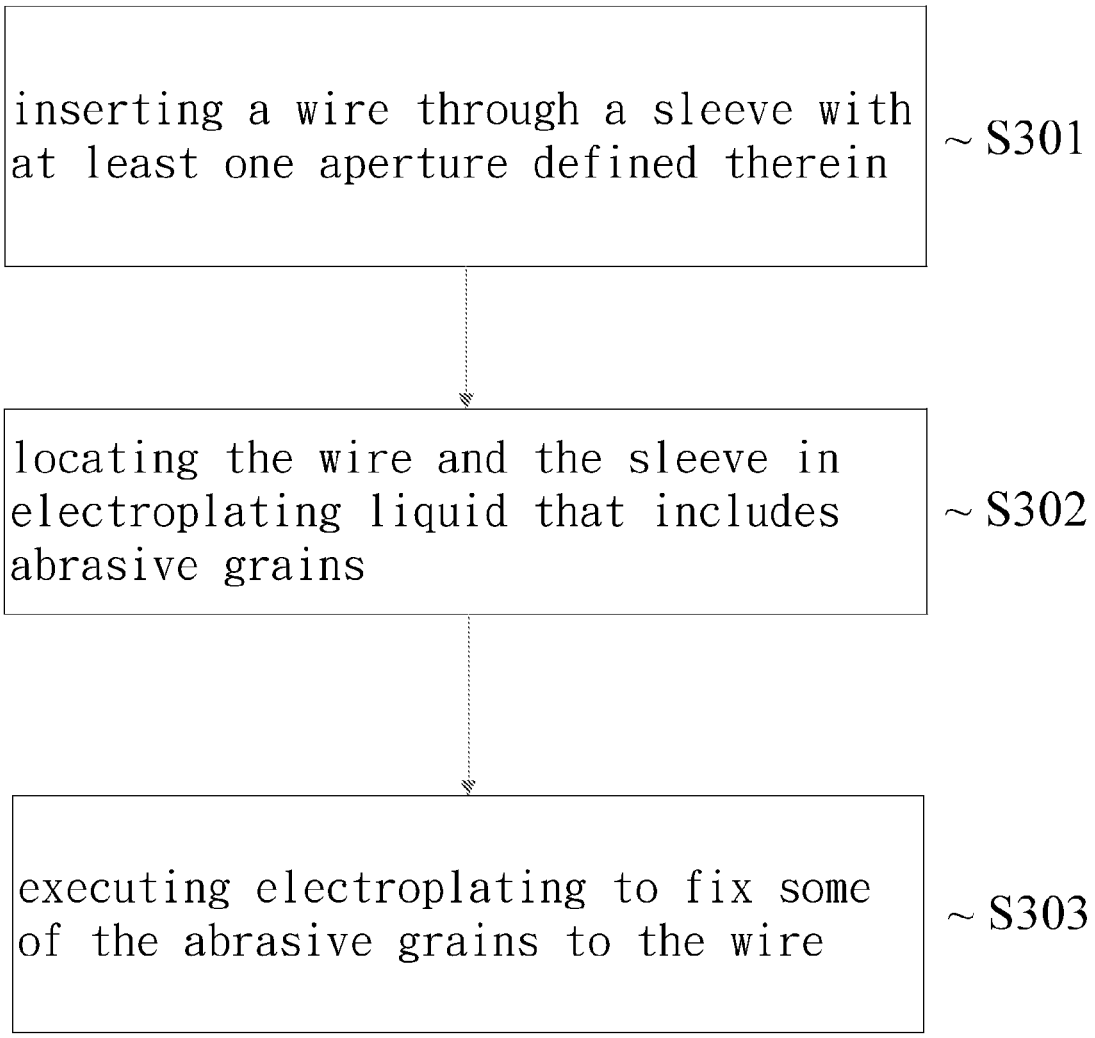
FIG. 3 is a flow chart of a method for making a fixed abrasive wire according to the second embodiment of the present invention.

Referring to FIG. 3, there is shown a method for making a fixed abrasive wire in an electroplating manner. At S301, a wire 130 is wound around the wheels 120 so that a section thereof is inserted through one of the sleeves 110 while another section thereof is inserted through the other sleeve 110. The wire 130 is moved through the sleeves 110 as it is driven by the wheels 120. The wire 130 is electrically connected to the cathode of the power supply 190.

At S302, the wire 130 and the sleeves 110 are submerged in the electroplating liquid 170 filled in the tank 150.

At S303, the power supply 190 is turned on to execute electroplating. Thus, the abrasive grains 180 move toward the wire 130 via the apertures 160, and some of the abrasive grains 180 are fixed to the wire 130. The wire 130 and the abrasive grains 180 fixed to the wire 130 become a fixed abrasive wire for slicing.

Figure 4:
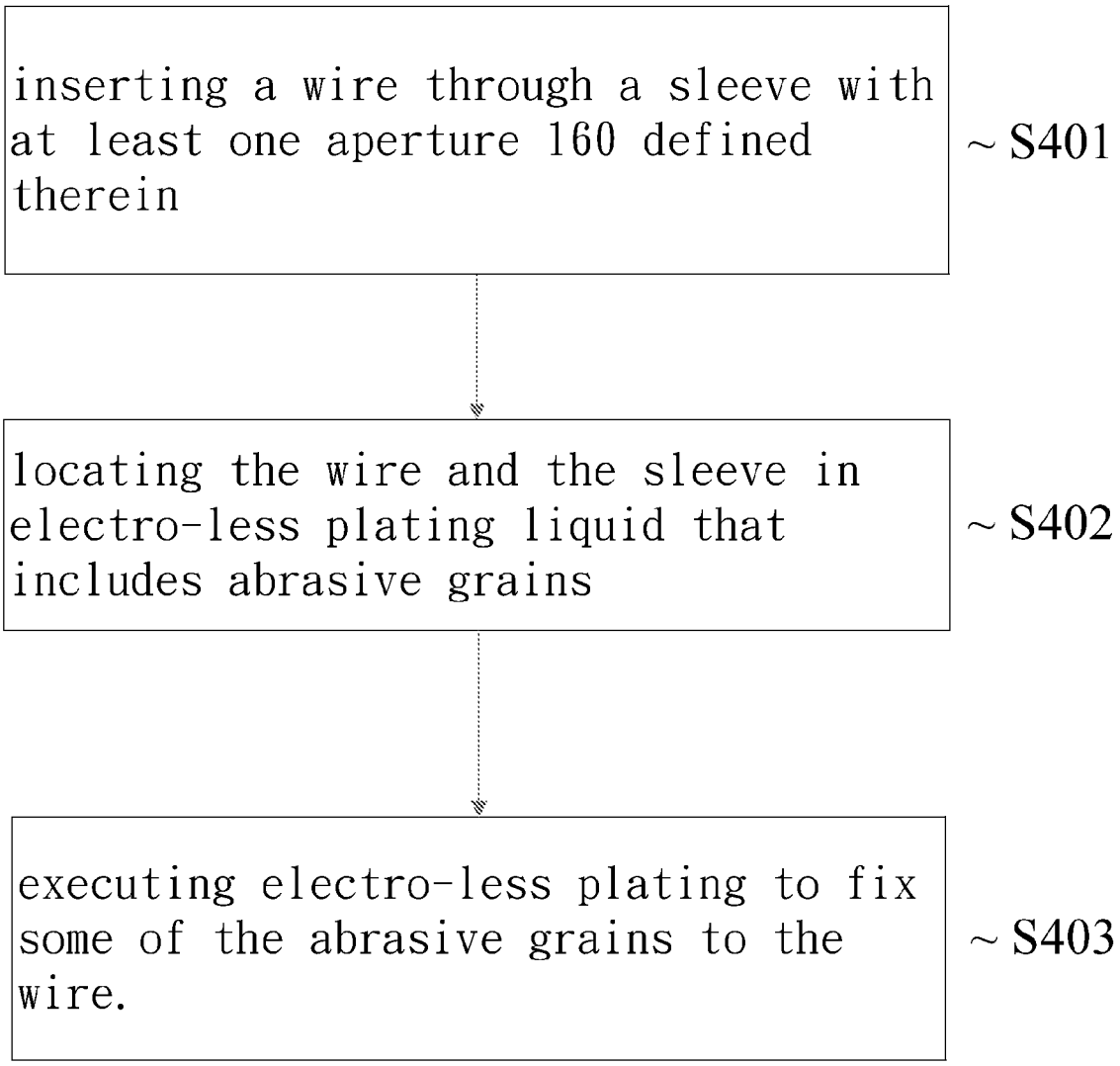
FIG. 4 is a front view of an apparatus for making a fixed abrasive wire according to the third embodiment of the present invention.

Referring to FIG. 4, there is shown a method for making a fixed abrasive wire in an electroplating manner. At S401, a wire 130 is wound around the wheels 120 so that a section thereof is inserted through one of the sleeves 110 while another section thereof is inserted through the other sleeve 110. The wire 130 is moved through the sleeves 110 as it is driven by the wheels 120. The wire 130 is electrically connected to the cathode of the power supply 190.

At S402, the wire 130 and the sleeves 110 are submerged in the electro-less plating liquid 170 filled in the tank 150.

At S403, the abrasive grains 180 move toward the wire 130 through the apertures 160 so that some of the abrasive grains 180 are fixed to the wire 130. The wire 130 and the abrasive grains 180 fixed to the wire 130 become a fixed abrasive wire for slicing.

Figure 5:
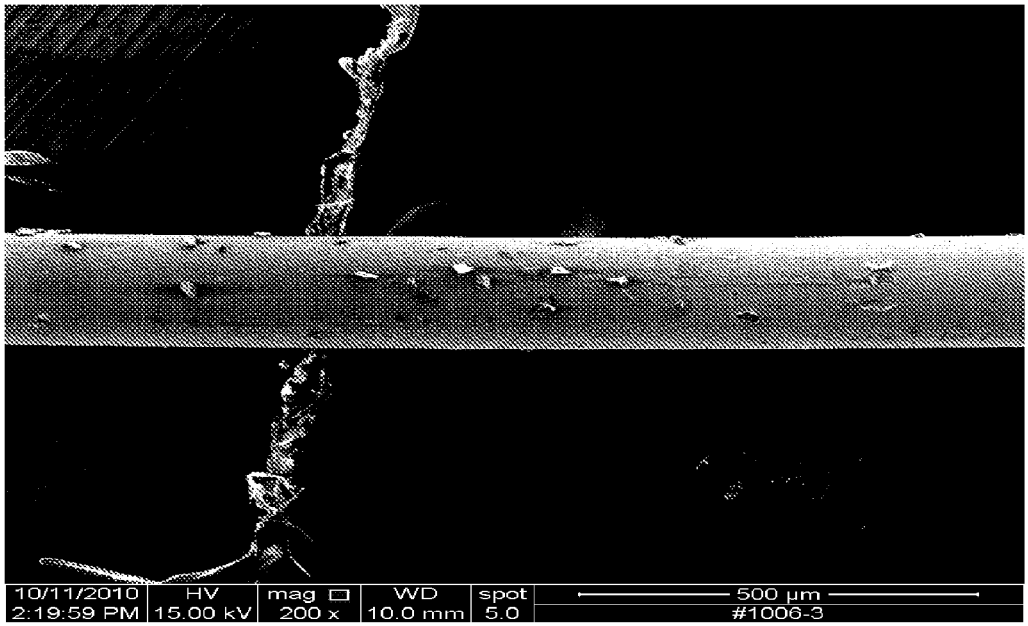
FIG. 5 is a SEM photograph of a fixed abrasive wire made according to the present invention.

In another embodiment, the reaction liquid 170 is electroplating liquid including 500 grams of $Ni(NH_2SO_3)_2.4H_2O$, 10 grams of $NiCl.6H_2O$ and 40 grams of $H_3BO_3$. The operative temperature is 40° C. to 50° C. The pH value is 3.8 to 40. The current density is 4 A/dm$^2$. The average diameter of the abrasive grains 180 is 21 μm. The stirring rate is 350 to 370 rpm. The sleeves 110 are directed vertically in the tank 150. The apertures 160 are distributed on the tubular wall 210 of each of the sleeves 110 in a symmetric manner, and the distance between any two adjacent ones of the apertures 160 is 8 mm. The apertures 160 are circular, and the diameter of the apertures 160 is 0.1 mm. The open ends 220 of the sleeves 110 are circular, and the diameter of the open ends 220 is 4 mm. A SEM photograph of a resultant fixed abrasive wire is shown in FIG. 5. It is shown in the SEM photograph that the abrasive grains 180 are evenly distributed on the wire 130. The density of the distribution of the abrasive grains 180 on the wire 130 is about 55 to 70 grain/mm$^2$.

Figure 6:
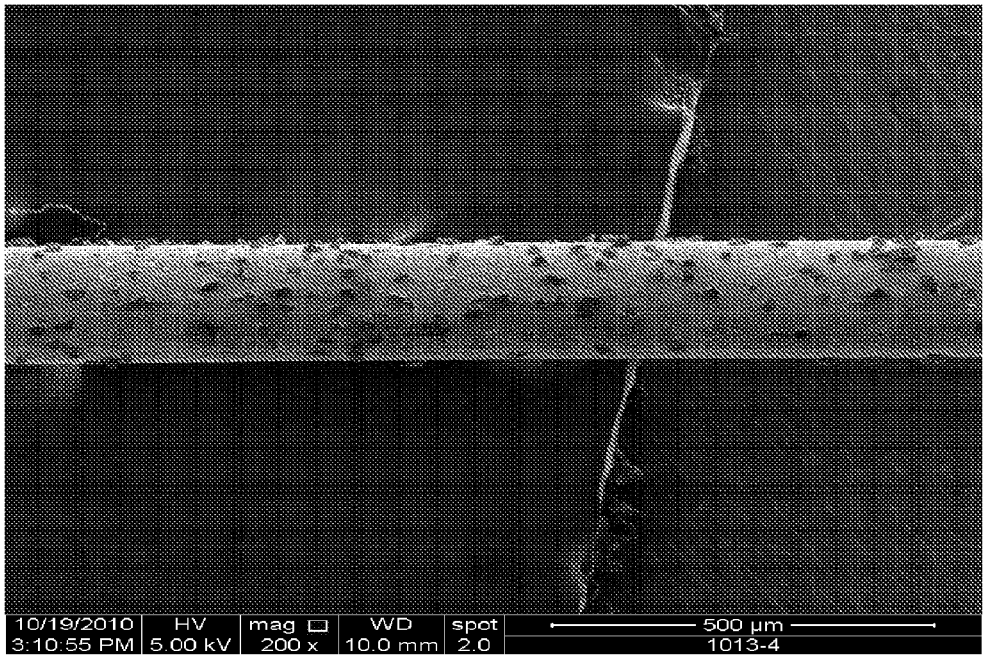
FIG. 6 is a SEM photograph of another fixed abrasive wire made according to the present invention.

In another embodiment, the reaction liquid 170 is electroplating liquid including 500 grams of $Ni(NH_2SO_3)_2.4H_2O$, 10 grams of $NiCl.6H_2O$ and 40 grams of $H_3BO_3$. The operative temperature is 40° C. to 50° C. The pH value is 3.8 to 40. The current density is 4 A/dm$^2$. The average diameter of the abrasive grains 180 is 21 μm. The stirring rate is 150 to 170 rpm. The sleeves 110 are directed vertically in the tank 150. The apertures 160 are distributed on the tubular wall 210 of each of the sleeves 110 in an alternate manner, and the distance between any two adjacent ones of the apertures 160 is 1.5 mm. The apertures 160 are circular, and the diameter of the apertures 160 is 1.8 mm. The open ends 220 of the sleeves 110 are circular, and the diameter of the open ends 220 is 4 mm. A SEM photograph of a resultant fixed abrasive wire is shown in FIG. 6. It is shown in the SEM photograph that the abrasive grains 180 are evenly distributed on the wire 130. The density of the distribution of the abrasive grains 180 on the wire 130 is about 110 to 140 grain/mm$^2$.

Figure 7:
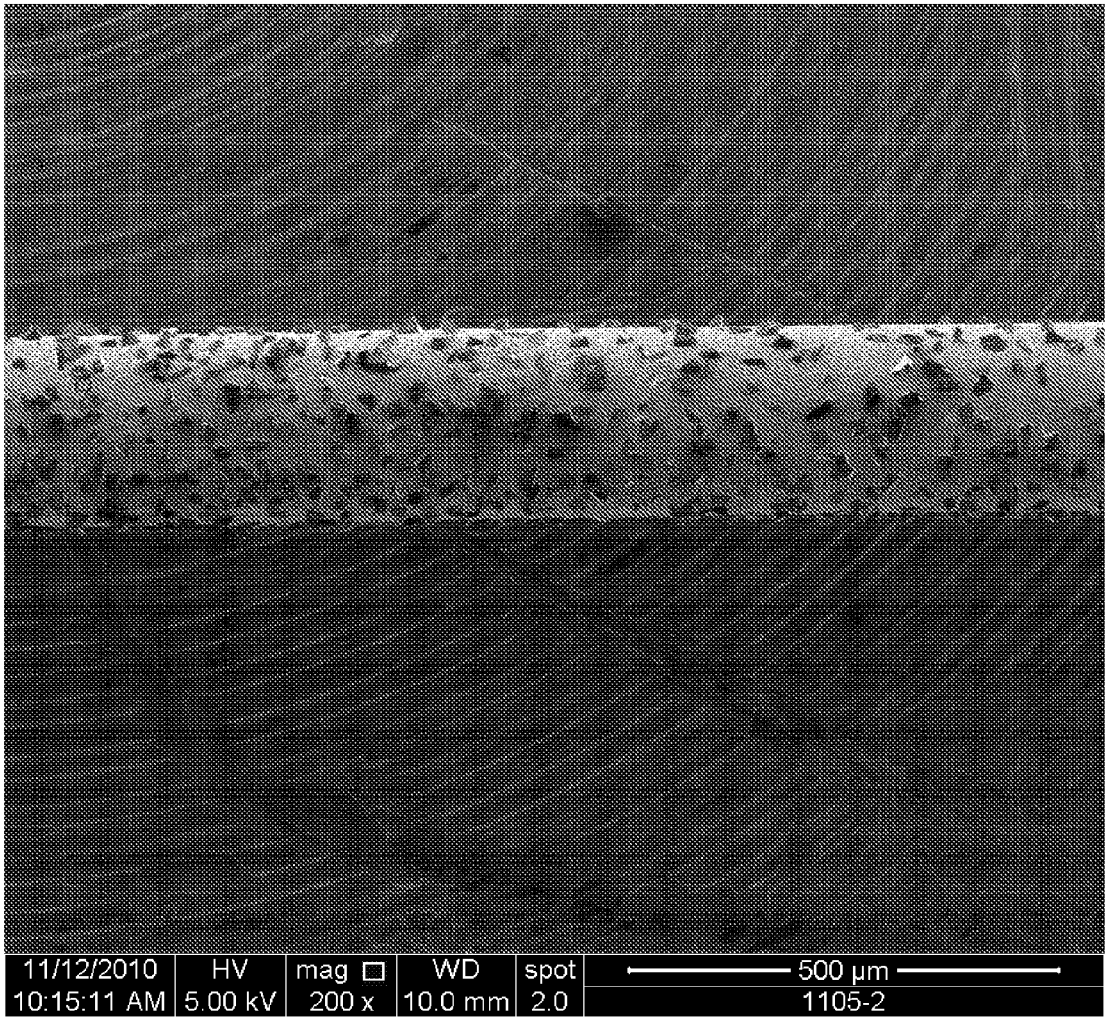
FIG. 7 is a SEM photograph of another fixed abrasive wire made according to the present invention.

In another embodiment, the reaction liquid 170 is electroplating liquid including 600 grams of $Ni(NH_2SO_3)_2.4H_2O$, 12 grams of $NiCl.6H_2O$ and 42 grams of $H_3BO_3$. The operative temperature is 55° C. to 60° C. The pH value is 3.8 to 40. The current density is 32 A/dm$^2$. The average diameter of the abrasive grains 180 is 21 μm. The stirring rate is 150 to 170 rpm. The sleeves 110 are directed horizontally in the tank 150. The apertures 160 are distributed on the tubular wall 210 of each of the sleeves 110 in an alternate manner, and the distance between any two adjacent ones of the apertures 160 is 1.5 mm. The apertures 160 are circular, and the diameter of the apertures 160 is 1.8 mm. The open ends 220 of the sleeves 110 are circular, and the diameter of the open ends 220 is 4 mm. A SEM photograph of a resultant fixed abrasive wire is shown in FIG. 7. It is shown in the SEM photograph that the abrasive grains 180 are evenly distributed on the wire 130. The density of the distribution of the abrasive grains 180 on the wire 130 is about 200 to 280 grain/mm$^2$.

The present invention has been described via the detailed illustration of the embodiments. Those skilled in the art can derive variations from the embodiments without departing from the scope of the present invention. Therefore, the embodiments shall not limit the scope of the present invention defined in the claims.

The invention claimed is:

1. A method for making a fixed abrasive wire including the steps of:

inserting a wire 130 through a sleeve 110 including at least one aperture 160 defined therein;

locating the wire 130 and the sleeve 110 in electroplating liquid 170 including abrasive grains 180 blended therein; and executing electroplating to fix some of the abrasive grains 180 to the wire 130.

2. The method according to claim 1, wherein the sleeve 110 includes at least one open end 220 in a shape selected from the group consisting of circular, oval, triangular and rectangular.

3. The method according to claim 2, wherein the open end 220 of the sleeve 110 is circular, and the diameter thereof is 1 to 20 mm.

4. The method according to claim 1, wherein the aperture 160 is in a shape selected from the group consisting of circular, oval, triangular and rectangular.

5. The method according to claim 4, wherein the aperture 160 is circular, and the diameter thereof is 0.05 to 10 mm.

6. The method according to claim 1, wherein the abrasive grains 180 are made of a material selected from the group consisting of silicon carbide, baron carbide, tungsten carbide, baron nitride, diamond, aluminum oxide, zirconium oxide and quartz.

7. The method according to claim 1, wherein the abrasive grains 180 are spherical, and the diameter thereof is 1 to 60 μm.

8. The method according to claim 1, wherein the sleeve 110 is located in a manner selected from the group consisting of vertical, horizontal and inclined.

* * * * *